US012409918B2

(12) United States Patent
Snyder

(10) Patent No.: US 12,409,918 B2
(45) Date of Patent: Sep. 9, 2025

(54) FLOTATION HARNESS AND KINETIC SAFETY SYSTEM

(71) Applicant: Elizabeth Ann Snyder, Apopka, FL (US)

(72) Inventor: Elizabeth Ann Snyder, Apopka, FL (US)

( * ) Notice: Subject to any disclaimer, the term of this patent is extended or adjusted under 35 U.S.C. 154(b) by 0 days.

(21) Appl. No.: 18/244,123

(22) Filed: Sep. 8, 2023

(65) Prior Publication Data

US 2024/0083559 A1 Mar. 14, 2024

Related U.S. Application Data

(60) Provisional application No. 63/405,352, filed on Sep. 9, 2022.

(51) Int. Cl.
*B63C 9/26* (2006.01)
*B63C 9/11* (2006.01)

(52) U.S. Cl.
CPC . *B63C 9/26* (2013.01); *B63C 9/11* (2013.01)

(58) Field of Classification Search
None
See application file for complete search history.

(56) References Cited

U.S. PATENT DOCUMENTS 4,973,277 A * 11/1990 Khanamirian ..... B63C 9/11 441/106
5,192,238 A * 3/1993 Brown ..... B63C 9/00 441/84
5,839,932 A * 11/1998 Pierce ..... B63C 9/1255 441/84
6,880,702 B1 * 4/2005 Colorado ..... A45F 3/02 206/388
8,584,799 B1 * 11/2013 Dennington ..... A62B 35/04 182/4
9,320,925 B2 * 4/2016 Wise ..... A62B 1/16
9,931,525 B2 * 4/2018 Seman ..... A62B 35/0025
2004/0058598 A1 * 3/2004 Miller ..... B63C 9/115 441/115
2008/0153370 A1 * 6/2008 Wagner ..... B63C 9/11 441/115
2012/0222912 A1 * 9/2012 Wood ..... A62B 35/0031 182/6
2014/0322998 A1 * 10/2014 Mead ..... B63C 9/11 441/84
2020/0023928 A1 * 1/2020 Ngo ..... B63C 9/115

* cited by examiner

*Primary Examiner* — S. Joseph Morano
*Assistant Examiner* — Jovon E Hayes
(74) *Attorney, Agent, or Firm* — Jason T. Daniel, Esq.; Daniel Law Offices, P.A.

(57) ABSTRACT

A flotation harness and kinetic safety system includes a vest-style harness having an internal buoyant material for functioning as a personal flotation device. An elongated kinetic recovery cord is connected to the back panel. A length adjustment mechanism is positioned along the cord and a clip is positioned along the distal end of the cord for engaging an overhead portion of a boat. At least one adjustment belt is positioned along the harness body. A pelvic support panel extends down from the back panel of the harness body and connect to the front panels. The pelvic support panel works in conjunction with the kinetic recovery cord to selectively support the weight of a user as the boat encounters waves.

9 Claims, 5 Drawing Sheets

FLOTATION HARNESS AND KINETIC SAFETY SYSTEM

CROSS-REFERENCE TO RELATED APPLICATIONS

This application claims the benefit of U.S. Application Ser. No. 63/405,352 filed on Sep. 9, 2022, the contents of which are incorporated herein by reference.

TECHNICAL FIELD

The present invention relates generally to boat safety devices, and more particularly to a wearable flotation harness with a kinetic safety strap system.

BACKGROUND

The statements in this section merely provide background information related to the present disclosure and may not constitute prior art.

When traveling by boat on open water, the speed of the boat plays a large impact on the forces encountered by the boat passengers. For example, a 30-foot boat traveling at 5-10 mph in sea swells of 1.5 ft to 2 ft results in a noticeable and somewhat gentle up and down movement of the boat and passengers. However, the same vessel traveling at 20-25 mph in the identical seas results in much more rapid up and down movements wherein the bow lifts out of the water and then violently crashes down with each swell. Of course, this movement is greatly exacerbated with smaller boats and/or increased wave size or speed.

To this end, many passengers will attempt to remain seated during rough seas. Unfortunately, it is not uncommon for these individuals to experience short term or long-term injuries to their neck or back due to the rapid crashing motion of the boat. Conversely, when these individuals remain standing, they are at risk of falling which can cause additional injuries.

In order to ensure boater safety, the United States Coast Guard mandates that each vessel have at least one USCG-approved life vest for every passenger. Although this requirement helps to ensure that a passenger who falls overboard will remain on the surface of the water, it does not help to prevent the passenger from falling in the first place. Moreover, it does nothing to ease the discomfort to the passenger during rough rides.

Accordingly, it would be beneficial to provide a boat flotation harness and kinetic safety system that can be utilized by passengers on many different types of vessels so as to overcome the drawbacks noted above.

SUMMARY OF THE INVENTION

The present invention is directed to a flotation harness and kinetic safety system. One embodiment of the present invention can include a vest-style harness body having a pair of front panels, a back panel, a head opening, a body opening and a pair of arm openings. The harness can include an internal buoyant material for functioning as a personal flotation device when a user wearing the harness is suspended in water. In the preferred embodiment, the harness will be constructed and certified by the United States Coast Guard as an approved personal flotation device.

An elongated kinetic recovery cord is connected to the back panel. The cord can include a length adjustment mechanism, an elastomeric construction, and can include a clip for engaging an overhead portion of a boat. At least one adjustment belt can be positioned along the harness body for securing the harness about the torso of a user, and a pelvic support panel can extend down from the back panel of the harness body and connect to the front panels. The pelvic support panel can work in conjunction with the kinetic recovery cord to selectively support the weight of a user as the boat encounters waves.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
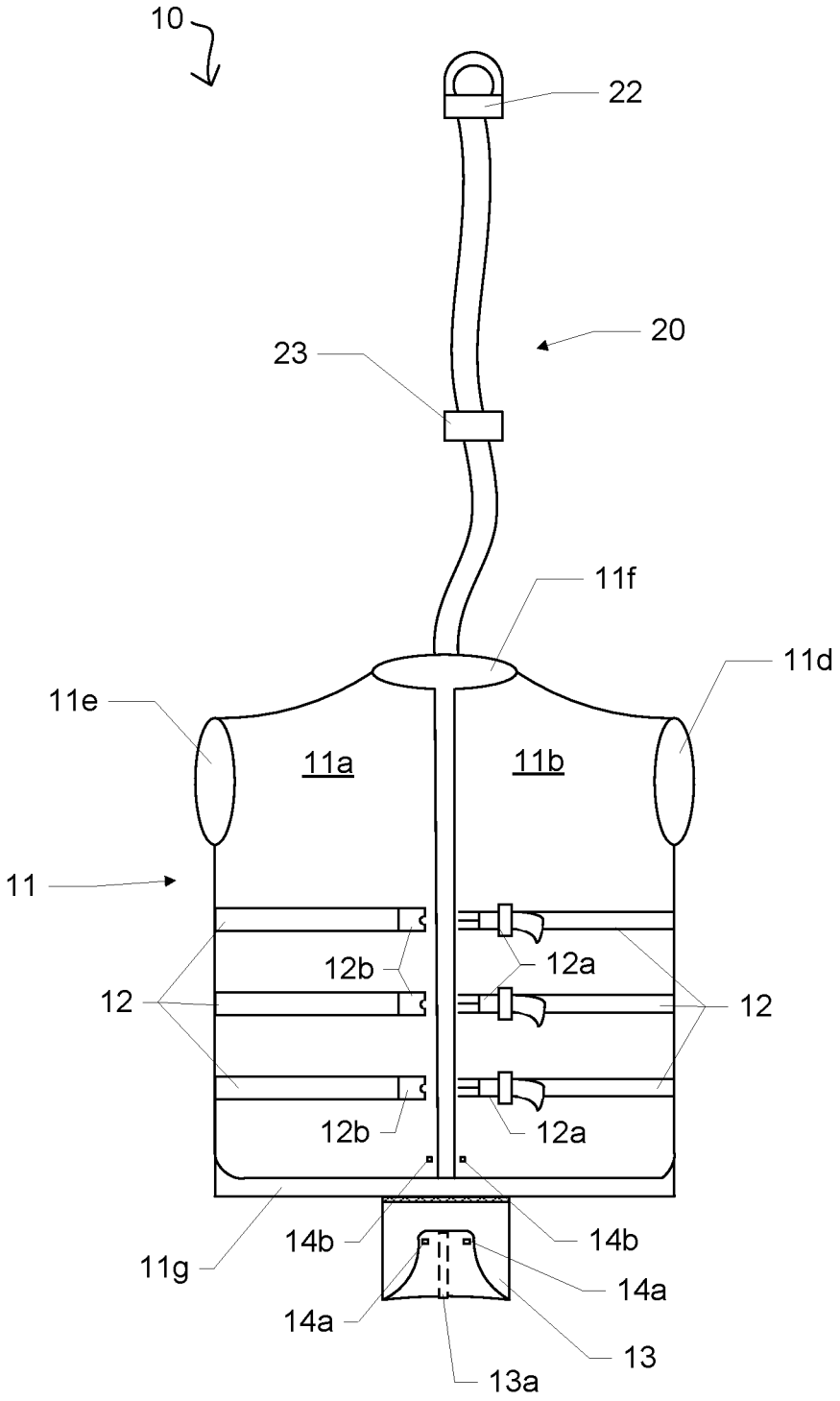
FIG. 1 is a front view of the flotation harness and kinetic safety system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include, but are not limited to, flexible strips of interlocking projections with a slider (i.e., zipper), thread-to-connect, twist-to-connect, and push-to-connect type devices, opposing strips of hook and loop material (e.g., Velcro®), attractively oriented magnetic elements or magnetic and metallic elements, buckles such as side release buckles, clamps, sockets, clips, carabiners, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described herein, the term "resilient memory" is defined as the ability of a component to maintain a particular shape and to attempt to return to the particular shape after being bent, stretched, folded, twisted or otherwise manipulated.

FIGS. 1-5 illustrate one embodiment of a flotation harness and kinetic safety system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in the drawings, the system 10 can include, essentially, a flotation harness 11 having a kinetic recovery cord 20 that is removably coupled to an overhead area of a boat.

In the preferred embodiment, the flotation harness 11 can include the illustrated vest design having front panels 11*a* and 11*b*, a back panel 11*c*, arm openings 11*d* and 11*e*, a neck opening 11*f* and a body opening 11*g*. As described herein, the harness can be constructed in any number of different sizes so as to be worn by male or female users ranging from small children to adults with any body style.

In one embodiment, the harness 11 will be constructed from materials suitable for providing flotation to a wearer in a fresh or saltwater environment. For example, the vest may be constructed from an outer nylon or neoprene fabric that encloses buoyant closed cell foam, for example. To this end, the vest 11 will preferably be constructed in accordance with current United States Coast Guard standards, so as to comprise a type 1, type 2 or type 3 USCG approved personal flotation device.

In one embodiment, a plurality of adjustment belts 12 can be positioned along the main body. Each of the belts 12 can include connectors 12*a* and 12*b*, such as the illustrated male and female buckles, for example, which can function to allow a user to tighten the harness securely about their body. Although not specifically illustrated, any number of additional adjustment belts may be provided at different locations along the outside surface, and/or the inside surface of the harness to permit the user to adjust the fit of the harness to suit their body in any number of different ways.

In one embodiment, a pelvic support panel 13 can extend downward from the back panel 11*b*. The pelvic support panel can be removably secured to the front panels 11*a* and 11*b* via additional connectors 14*a* and 14*b*, such as twist lock fasteners, for example, however, any number of other connectors can be used.

The pelvic support panel is designed to be positioned between the legs of a user, and to support the weight of the user when the harness is secured to an overhead portion of a boat. To this end, the pelvic support panel will preferably be constructed from the same cushioned and buoyant material as the harness body 11, so as to provide a soft and malleable surface for contacting with the body of the wearer. Depending on the anticipated weight of the wearer, the pelvic support panel may include one or more inelastic straps 13*a* which can be positioned within the support material.

Although described above with regard to a particular shape, size or construction material, this is for illustrative purposes only, as many other shapes, sizes and construction materials are also contemplated. For example, the pelvic strap can be formed to include two leg openings for receiving the legs of a user. The leg openings may be adjustable or may include connectors for opening and securing the leg openings about the thighs/upper legs of the user.

Figure 2:
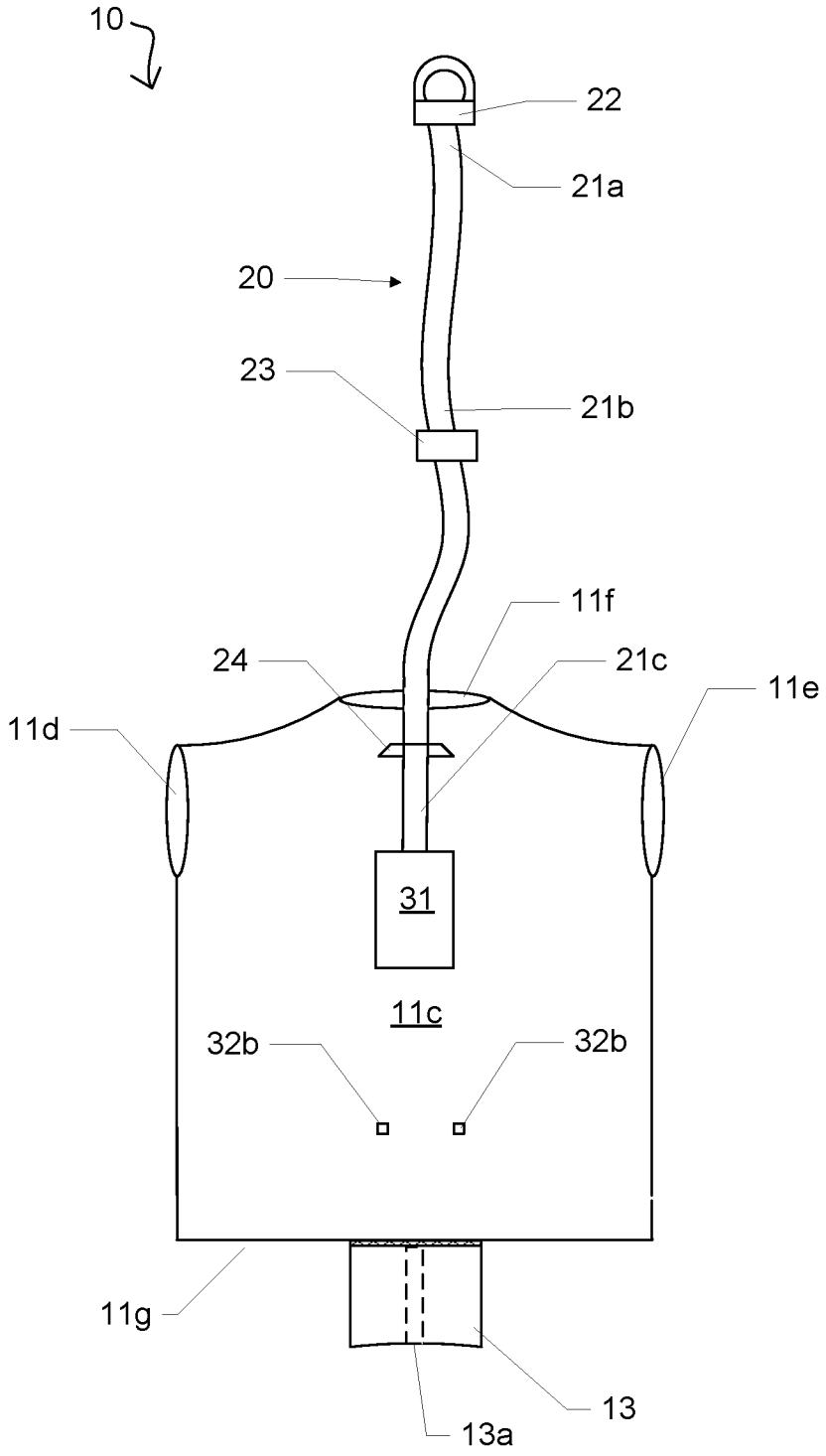
FIG. 2 is a back view of the flotation harness and kinetic safety system in accordance with one embodiment of the invention.

As shown best at FIG. 2, an elongated resilient and elastomeric kinetic recovery cord 20 can be provided. In the preferred embodiment, the cord can include a length of about 4 feet and can include a working load rating of at least 750 pounds. Such a rating was specifically chosen in order to provide a 3× safety margin for ensuring the device can support up to three times the weight of a user having a weight of 250 pounds. Of course, any number of other lengths and working load ratings are also contemplated.

As shown, the cord can include a first end 21*a*, having a releasable clip 22 or other such connector thereon. The releasable clip functions to secure the cord onto an overhead area of a boat during operation. Additionally, a length adjustment mechanism 23 can be provided along the middle portion 21*b* of the cord, to permit users to adjust the length of the cord to suit their height.

In the preferred embodiment, the second end 21*c* of the cord can be permanently connected to the back panel 11*c* of the harness via reinforced stitching or other such components, and a guide loop 24 can be positioned adjacent to the neck opening 11*f* to orient the cord upward during use.

Figure 3:
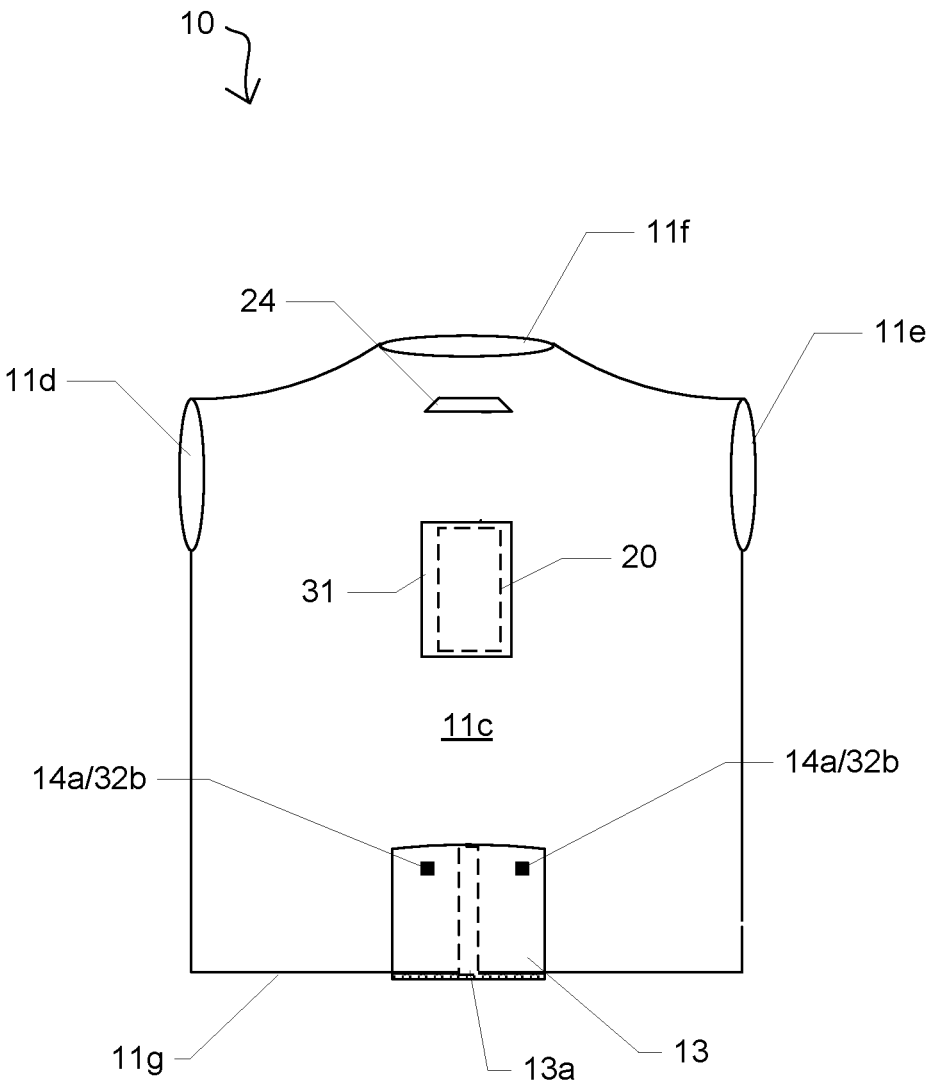
FIG. 3 is another back view of the flotation harness and kinetic safety system in accordance with one embodiment of the invention.

As shown best at FIG. 3, the harness can be designed to function as a traditional lifejacket when the cord 20 is not connected to the boat. In this regard, the back panel 11*c* can include a pocket 31 into which the cord can be positioned, and a second pair of connectors 32*b* for engaging the connectors 14*a* of the pelvic support strap.

Figure 4:
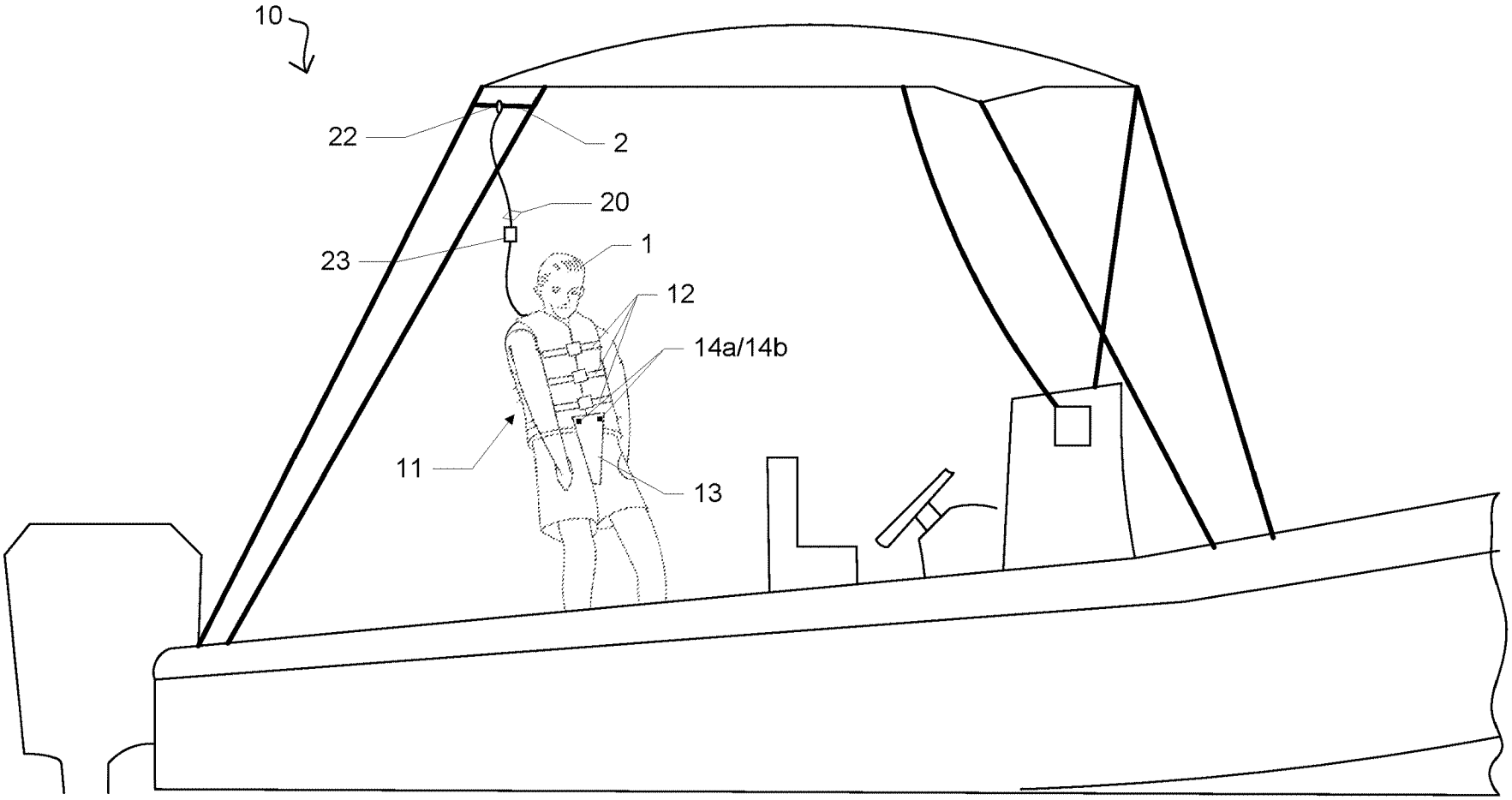
FIG. 4 is a perspective view of the flotation harness and kinetic safety system in operation, in accordance with one embodiment of the invention.

FIG. 4 illustrates one embodiment of the device 10 in operation. As shown, a user 1 can position the harness 11 about their torso and the pelvic strap 13 between their legs. When so positioned, the connector 22 on the first end of the cord 20 can be secured onto an overhead portion of the boat 2, such as the cross bar of the T-top, for example. Next, the length of the cord can be adjusted 23 so that the cord imparts a slight (e.g., 5-10 pounds) of upward pressure onto the user. As the boat travels through the water and the user's body moves up and down, the cord can selectively support and release the weight of the user, thus greatly reducing or eliminating the drastic bouncing impact on the user's back and legs.

Figure 5:
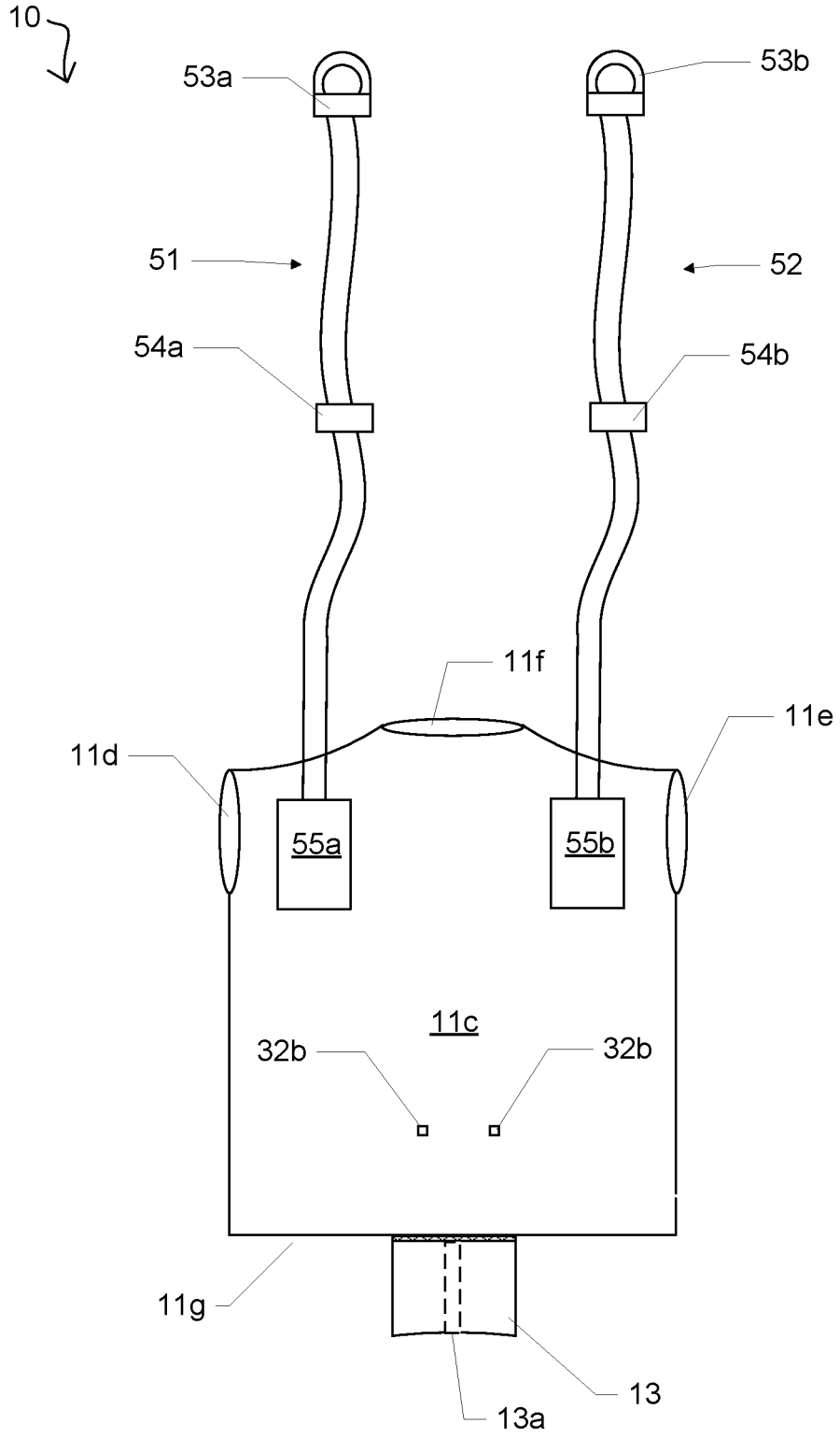
FIG. 5 is another back view of the flotation harness and kinetic safety system in accordance with one embodiment of the invention.

Although described above with regard to a single cord 20 that is located centrally along the back panel of the harness, other embodiments are contemplated. To this end, FIG. 5 illustrates one embodiment of the system 10 that includes a plurality of cords 51 and 52 that are provided along one or more of the back, side, top and/or front panels of the harness 11 so as to extend upward from the shoulder area of the user.

As described herein, each of the cords 51 and 52 can be substantially identical to the cord 20 described above. To this end, each of the cords can include releasable clips 53*a* and 53*b* that are substantially identical to the releasable clip 22 described above, length adjustment mechanisms 54*a* and 54*b* that are substantially identical to the length adjustment mechanism 23 described above, and storage pockets 55*a* and 55*b* that are substantially identical to the pocket 31 described above.

By providing a plurality of cords which extend from the harness, the system advantageously allow a user to remain comfortably suspended from an overhead portion of the boat with their feet off the ground indefinitely. Such a feature permits the system to act as a shock absorbing seat or swing for use on the boat regardless of the sea conditions.

As to a further description of the manner and use of the present invention, the same should be apparent from the above description. Accordingly, no further discussion relating to the manner of usage and operation will be provided.

Although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A safety system, comprising:

a harness body that is configured to be worn about a torso of a user, said harness body having a front panel and a back panel;

at least one adjustment belt that is positioned along the harness body;

a pelvic support panel having a first end that is connected to the back panel of the harness body, and a second end that is configured to be removably secured to the front panel by a plurality of connectors; and at least one elongated cord having a first end that is connected to the harness body, and a second end that is configured to be connected to an overhead portion of a vessel.

2. The system of claim 1, wherein the at least one elongated cord comprises a single kinetic recovery cord.

3. The system of claim 2, wherein the kinetic recovery cord is positioned along a center portion of the back panel and is configured to selectively support a weight of the user when the second end of the elongated cord is connected to the overhead portion of the vessel.

4. The system of claim 1, further comprising:

an inelastic support strap that extends from the first end of the pelvic support panel to the second end of the pelvic support panel.

5. The system of claim 4, wherein the inelastic strap is positioned inside the pelvic support panel.

6. The system of claim 1, wherein each of the at least one adjustment belt includes a first end and a second end.

7. The system of claim 6, wherein the first end and second end of each of the at least one adjustment belt are removably connected by a pair of connectors.

8. The system of claim 1, wherein the harness comprises a vest-shape having a pair of front panel sections, a head opening, a bottom opening and a pair of arm openings.

9. The system of claim 1, further comprising:

a cord guide that is positioned along the back panel, said cord guide functioning to receive and position the cord along a center portion of the back panel.

* * * * *